United States Patent [19]

Scattaregia

[11] 4,438,865

[45] Mar. 27, 1984

[54] ANTI-SPILL LID FOR A DRINKING CUP

[75] Inventor: Joseph J. Scattaregia, 112 Malvern Dr., Normal, Ill. 61761

[73] Assignee: Joseph J. Scattaregia, Normal, Ill.

[21] Appl. No.: 483,553

[22] Filed: Apr. 11, 1983

[51] Int. Cl.[3] ..... B65D 41/26; B65D 47/10

[52] U.S. Cl. ..... 220/270; 220/90.2; 220/90.4; 220/254; 220/266; 229/7 R; 229/7 S

[58] Field of Search ..... 220/90.2, 90.4, 268, 220/269, 270, 254, 265, 266; 229/7 S, 7 R, 43

[56] References Cited

U.S. PATENT DOCUMENTS

| | | | |
|---|---|---|---|
| 3,048,317 | 8/1962 | Cochrane et al. | 229/7 S |
| 3,337,085 | 8/1967 | Bozek | 220/270 |
| 3,370,169 | 2/1968 | Bozek | 220/270 |
| 3,397,830 | 8/1968 | Chang | 229/7 S |
| 3,441,168 | 4/1969 | Luviano | 220/270 |
| 3,800,999 | 4/1974 | Serritella | 229/7 R |
| 4,056,210 | 11/1977 | Boyle | 229/7 R X |
| 4,078,693 | 3/1978 | Asbury | 220/268 |
| 4,184,605 | 1/1980 | Hanson | 220/269 |
| 4,186,842 | 2/1980 | Albert | 220/90.4 X |
| 4,210,256 | 7/1980 | Ambers et al. | 220/254 |

*Primary Examiner*—Allan N. Shoap

*Attorney, Agent, or Firm*—McCaleb, Lucas & Brugman

[57] ABSTRACT

A lid for a drinking cup comprises a circular disk-like body having a down-turned channel section formed continuously about the periphery for engagement with the rim of a drinking cup. The body has a stiffening arcuate rib spaced inwardly of the peripheral channel section. The rib extends less than a full circle about the body and has circumferentially spaced opposite end portions. A pair of stiffening ribs extend transversely from the ends of the arcuate rib to the peripheral channel section providing a reinforced space for a tear-out tab between them. The sides of the tab are defined by weakened lines extending along the insides of the transverse stiffening ribs and the outer end of the tab is defined by a weakened line consisting of a through-slit extending along the inside of the peripheral channel. The inner end of the tab is an open, manually liftable point defined by intersecting weakened lines comprising through-slits of a perforatable straw aperture. The intersecting through-slits are common to both the drink tab and the perforatable straw aperture. The lid is optionally usable in one mode in which a straw is inserted through the straw aperture while the straw itself is partially supported by the inner end of the drink tab and in another mode after the tab is removed to provide a larger, reinforced drink opening including part of the straw aperture.

4 Claims, 8 Drawing Figures

ANTI-SPILL LID FOR A DRINKING CUP

BACKGROUND OF THE INVENTION

This invention relates to drinking cups and particularly to disposable drinking cup lids.

Many hot and cold drinks are served in disposable plastic cups. For carry-out customers, the cups have plastic lids to prevent spillage. Some of these lids have a tab which can be removed to provide a drink opening, or a straw insertion opening, to facilitate drinking the contents without removing the lid. This is especially useful when a beverage is taken to drink in a moving automobile. Conventional lids have several disadvantages, one of which is that, where there is a tear-out tab to provide a drink opening, the tab extends all the way out and includes the periphery of the lid. Removing the tab destroys the structural integrity of the lid, weakens the lid and cup assembly by removing the continuity of engagement between the peripheral section of the lid and rim of the cup, and disturbs the frictional seal between them making it highly susceptible to leakage.

Typically, where a straw insertion opening is provided, it comprises crossing through-slits in the lid body. This creates a pattern of adjacent pie-shaped sections with their apexes at a common center point. A drinking straw pressed through the opening sections displaces these sections enabling the straw to be inserted into the cup. One disadvantage of this typical construction is that it is difficult to insert the straw if the plastic material in the lid body is thick or stiff, or the crossed through-slits are short.

SUMMARY OF THE INVENTION

It is a general object of the present invention to provide a disposable drinking cup lid having an improved, combined tear-out tab and straw insertion aperture arrangement.

An important object of the invention is to provide by means of weakened lines and slits a tear-out drink tab to generate a drink opening at the edge of the lid but which terminates short of a peripheral channel section, thereby preserving the structural integrity of the channel section and maintaining its continuous sealing relationship with the cup rim.

Another object is to provide intersecting through-slits in the body of the lid which are common both to a tear-out tab and to a straw insertion aperture, thereby facilitating optional use of the tab, or the aperture, while certain structural elements of both are shared for advantages which will be described.

Another object is to provide a tear-out drink tab defined by weakened lines and slits in the body of the lid, and a straw insertion aperture sufficiently closely adjacent to the tab to deflect part of the tab when a straw is inserted through the aperture.

Another object is to provide such a lid in which a tear-out drink tab and a straw insertion aperture are positioned sufficiently close to one another, to share common structural elements, and both are supported and rigidified by immediately adjacent stiffening ribs on at least three sides.

Another object is to provide such a lid which is exceptionally strong, leak free and especially adaptable for use in a moving vehicle, for example, where a motorist purchases a cup of coffee or other beverage to drink along the way.

BRIEF DESCRIPTION OF THE DRAWINGS

Other objects and advantages will be apparent from the following description taken in connection with the accompanying drawings in which.

DETAILED DESCRIPTION OF THE DRAWINGS

Figure 1:
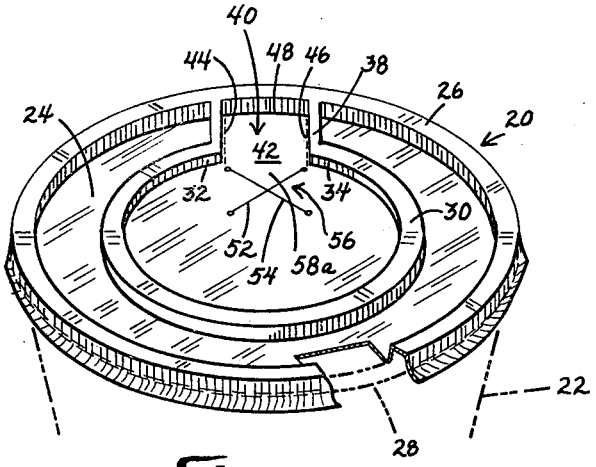
FIG. 1 is a partially broken away perspective view of a lid illustrating a preferred embodiment of the present invention on a cup, with a drink tab and straw insertion orifice in their closed and, as yet, unopened conditions.
Figure 2:
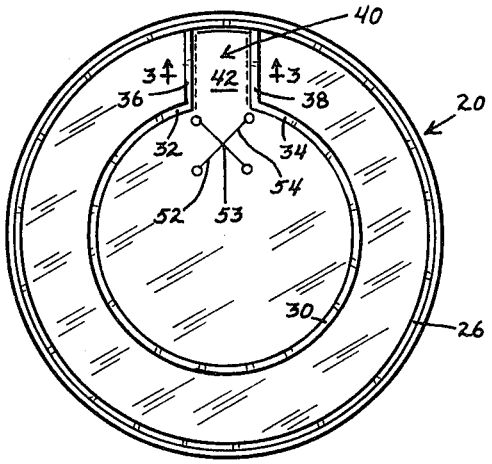
FIG. 2 is a top plan view of FIG. 1.

Referring first to the specific embodiment of the invention shown in FIGS. 1–7, this comprises a disposable plastic lid 20 for use on a disposable plastic cup 22.

The lid comprises a circular disk-like body 24 of plastic material having a circumferentially continuous, downwardly facing peripheral channel section 26 frictionally engageable with the rim 28 of the cup.

The body as illustrated is substantially flat, having a discontinuous stiffening arcuate rib 30 disposed inwardly of the peripheral channel section 26. It extends somewhat less than a full circle, having circumferentially spaced opposite ends 32 and 34.

Figure 3:
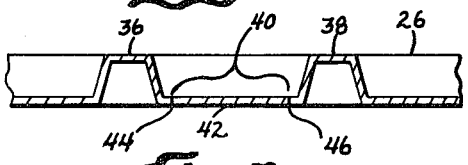
FIG. 3 is a fragmentary cross-sectional view of FIG. 2 taken along line 3—3.
Figure 7:
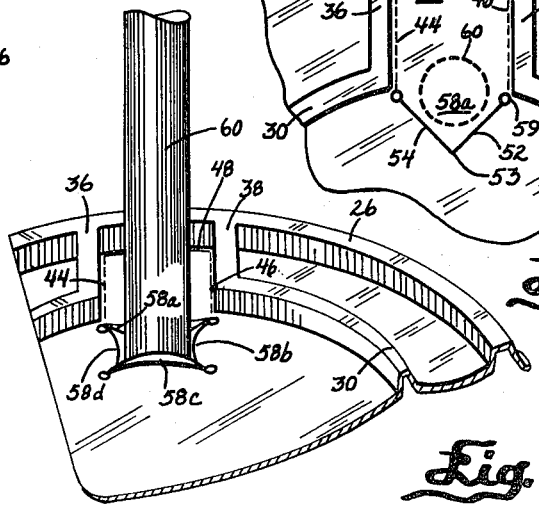
FIG. 7 is a fragmentary view of FIG. 6 with a straw inserted through the straw insertion aperture.

A pair of circumferentially spaced, parallel, stiffening transverse ribs 36 and 38 extend transversely (generally radially of the lid body) from the ends of the arcuate rib to the peripheral channel section 26. Each of ribs 30, 36 and 38 and the peripheral channel section 26 has an inverted U cross-section as best shown in FIGS. 1, 3 and 7. These ribs and channel section are integral with the body, being formed in the same molding or hot pressing operation, so they provide substantial stiffening and structural integrity to the lid while adding no significant weight or detracting from their stackability. In this regard, the ribs and channel may be slightly beveled to facilitate stacking. Other configurations of the stiffening ribs and channel section which achieve the desired stiffening effect may be employed. They may, for example, be rounded or square in cross-section, or the ribs may be concave on the top and convex on the bottom. While the flat body areas within and without the arcuate rib 30 are convenient and desirable spaces for trademark or advertising message purposes, additional ribs or decorative surface ornamentations may be provided there.

Thus, the lid body area 40 between, and immediately adjacent the transverse ribs 36, 38 has great strength and rigidity for the drink opening and straw insertion aperture which will now be described.

The lid body has a tear-out drink tab 42 in the stiffened area 40. The sides of the tab are defined by weakened lines 44 and 46 extending immediately alongside the inner edges of transverse ribs 36 and 38. The outer end of the tab is defined by a weakened arcuate line 48 extending along the inner edge of the peripheral channel section 26, connecting lines 44 and 46. The inner end of the tab is a manually liftable section 58*a* defined by intersecting, crossed, weakened lines 52, 54 extending between pairs of small apertures, 59, 59, all of which are part of a perforatable straw aperture generally designated 56. Although the invention is not limited to any particular dimensions, the apertures 59 59 will preferably be spaced somewhat further apart than the diameter of the straw 60. For example, where a standard 3/16" diameter straw is used, the "X" defined by the apertures 59 will preferably be approximately 5/16" square.

In the embodiment illustrated in FIGS. 1–7, the weakened lines 44, 46 are shown as scored or perforated at intervals and the weakened lines 48, 52 and 54 are through-slits extending completely through the body. These may be reversed, if desired; that is lines 44, 46 may be through-slits and lines 48, 52 and 54 may be scored or perforated. It is preferable, however, that lines 52, 54 be through-slits or substantially weakened, enabling ready deflection of the triangular quarter sections 58*a*, 58*b*, 58*c* and 58*d* when a straw 60 is inserted through them as shown in FIG. 7.

Another feature of the invention resulting from placing the tab 42 and straw aperture 56 adjacent one another is that they have in common the triangular quarter section 58*a*. This provides a dual advantage enabling the tab to tear outwardly part way along lines 44, 46 to facilitate insertion of a straw; and enabling section 58*a* comprising the inner end of the tab to be readily engaged and lifted by the user's fingernail incidental to removing the tab in the manner illustrated in FIG. 5.

Use and operation is believed to be apparent from the above description. Briefly, access to a milkshake, cold drink or other beverage which is normally sipped through a straw is had by thrusting the straw through the perforated straw aperture 56 in the manner shown in FIG. 7. Insertion is facilitated by the ready downward deflection of the triangular quarter sections 58*a*–58*d* and, if necessary, partial tearing outwardly of the tab 42 along lines 44 and 46.

Figure 5:
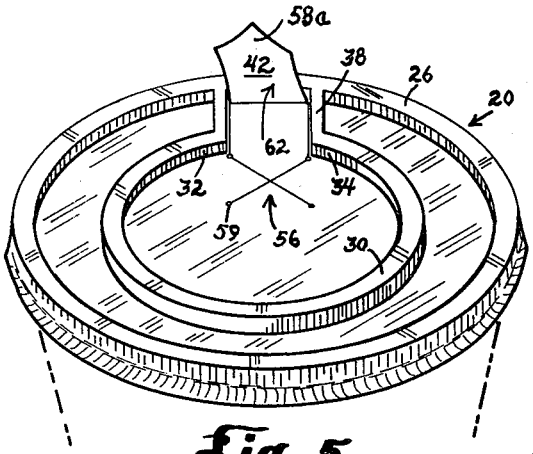
FIG. 5 is a perspective view of the embodiment shown in FIG. 1 with the drink tab torn off and in the process of being removed to provide a drink opening.
Figure 4:
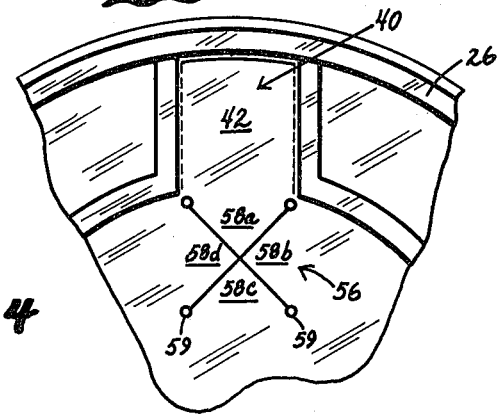
FIG. 4 is a fragmentary enlarged view of FIG. 2.
Figure 6:
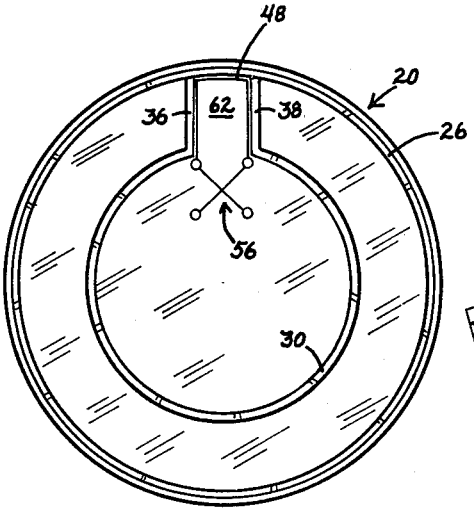
FIG. 6 is a top plan view similar to FIG. 2, with a drink opening ready for use.

Access to hot beverages such as coffee, tea, and the like which are normally sipped without use of a straw is had by engaging the inner triangular quarter section 58*a* of the tab 42 with the user's fingernail or some readily accessible tool, then lifting upwardly and outwardly as shown in FIG. 5. This produces a drink opening 42 as shown in FIGS. 5 and 6 where the beverage will be contained between ribs 36 and 38 as it is sipped through the drink opening. The ready deflectability of the adjacent triangular quarter sections 58*b*, 58*c* and 58*d* makes it easy to engage and lift the triangular section 58*a* (which as described is also the inner end of the tab).

Figure 8:
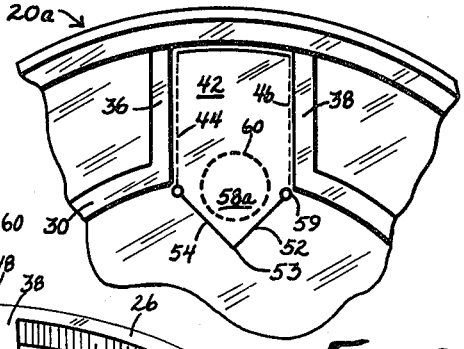
FIG. 8 is a view similar to FIG. 4 showing a modified form of straw insertion aperture.

Referring now to FIG. 8, this illustrates a modified form of lid 20*a* which is the same in all respects as lid 20 described above except that the intersecting slits 52*a* and 54*a* meet at a point 53*a*, instead of crossing at point 53 as slits 52 and 54 do. For drinking hot or cold liquids with the lid 20*a* in place, the inner section 58*a* of the tab is lifted upwardly and torn outwardly along lines 44 and 46. Alternatively, to use the straw 60 with the modified lid 20*a*, it is pressed through the lid at the location shown by the broken line circle in FIG. 8. The inner section 58*a* of the tab deflects downwardly, and it tears partially outwardly along lines 44 and 46 as needed to enable easy insertion of the straw.

The embodiments described and shown to illustrate the present invention have been necessarily specific for purposes of illustration. Alterations, extensions and modifications would be apparent to those skilled in the art.

The embodiments of the invention in which an exclusive property or privilege is claimed are defined as follows:

1. A lid for mounting on the rim of a drinking cup comprising:

a circular disk-like body having a circumferentially continuous, down-turned peripheral channel section engageable with the rim of the drinking cup;

the body having a stiffening arcuate rib spaced inwardly of the peripheral channel section, extending less than a full circle therewithin, and having circumferentially spaced opposite ends;

the body having a pair of circumferentially spaced stiffening transverse ribs extending transversely from the ends of the arcuate rib to the peripheral channel section;

the body having a tear-out drink tab between the transverse ribs, the sides of the tab being defined by weakened lines extending along the insides of the transverse ribs, the outer end of the tab being defined by a weakened line extending along the inside of the peripheral channel section between the transverse ribs, and the inner end of the tab comprising a manually liftable portion defined by intersecting weakened lines of a perforatable straw aperture;

whereby the intersecting weakened lines are common to the drink tab and the perforatable straw aperture; and whereby further the lid is optionally usable in one mode in which a straw is inserted through the straw aperture while the straw engages the inner end portion of the tab, and in another mode in which the tab is removed to provide a larger, reinforced drink opening including part of the straw aperture.

2. A lid according to claim 1 in which the intersecting weakened lines which are common to the drink tab and perforatable straw aperture are through-slits extending completely through the body of the lid.

3. A lid according to claim 1 in which the weakened line along the inside of the peripheral channel section is a through-slit extending completely through the body of the lid.

4. A lid according to claim 1 in which the intersecting weakened lines which are common to the drink tab and straw aperture cross one another in an X-configuration and are located radially inwardly of the tab within that portion of the body bounded by the arcuate rib.

* * * * *